US012606222B2

(12) United States Patent
Wang et al.

(10) Patent No.: US 12,606,222 B2
(45) Date of Patent: Apr. 21, 2026

(54) TRAIN OBSTACLE INFORMATION DISPLAY METHOD AND DEVICE

(71) Applicant: CASCO SIGNAL LTD., Shanghai (CN)

(72) Inventors: Siyuan Wang, Shanghai (CN); Hongzhou Cui, Shanghai (CN); Yaodong Jiang, Shanghai (CN)

(73) Assignee: CASCO SIGNAL LTD., Shanghai (CN)

( * ) Notice: Subject to any disclaimer, the term of this patent is extended or adjusted under 35 U.S.C. 154(b) by 24 days.

(21) Appl. No.: 18/836,288

(22) PCT Filed: Nov. 30, 2022

(86) PCT No.: PCT/CN2022/135650

§ 371 (c)(1),
(2) Date: Aug. 6, 2024

(87) PCT Pub. No.: WO2024/055439

PCT Pub. Date: Mar. 21, 2024

(65) Prior Publication Data

US 2025/0162624 A1 May 22, 2025

(30) Foreign Application Priority Data

Sep. 14, 2022 (CN) ..... 202211113393.8

(51) Int. Cl.

*B61L 23/04* (2006.01)
*B61L 15/00* (2006.01)
*B61L 27/70* (2022.01)

(52) U.S. Cl.

CPC ..... *B61L 23/041* (2013.01); *B61L 15/009* (2013.01); *B61L 27/70* (2022.01)

(58) Field of Classification Search

CPC ..... B61L 23/041; B61L 23/00; B61L 23/04; B61L 15/009; B61L 15/0027; B61L 15/00; B61L 27/70; B61L 27/20; B61L 25/02

(Continued)

(56) References Cited

FOREIGN PATENT DOCUMENTS

CN 105416340 A 3/2016
CN 108791368 A 11/2018

(Continued)

OTHER PUBLICATIONS

International Search Report (with English translation) and Written Opinion issued in PCT/CN2022/135650, dated Apr. 21, 2023, 12 pages provided.

(Continued)

*Primary Examiner* — Hai H Huynh
(74) *Attorney, Agent, or Firm* — HSML P.C.

(57) ABSTRACT

The invention relates to a train obstacle information display method and device. The method allows a train attendant to obtain the operating state of an on-board obstacle detection system in real time and informs the train attendant immediately when an obstacle disturbing train operation appears, such that the train attendant walks to the head of a train to handle a traffic interruption accident caused by the obstacle; and when reaching the head of the train, the train attendant handles the accident according to an approach suggested by a handheld mobile terminal. Compared with the prior art, the invention can display obstacle information to train attendants on metro lines in a DTO mode and a UTO mode.

11 Claims, 2 Drawing Sheets

(58) Field of Classification Search
USPC ..... 701/19, 20
See application file for complete search history.

(56) References Cited

FOREIGN PATENT DOCUMENTS

| | | | | | |
|---|---|---|---|---|---|
| CN | 109120701 | A | | 1/2019 | |
| CN | 112230245 | A | * | 1/2021 | ..... G01S 17/931 |
| JP | 2004126650 | A | * | 4/2004 | ..... B61L 23/00 |
| JP | 2008168675 | A | | 7/2008 | |

OTHER PUBLICATIONS

Wang, "Application and Research on Intelligent Handheld Devices in Railway Maintenance Operation Systems", China Market, Issue 6, Feb. 28, 2017—ISSN 1005-6432, with machine translation.

Xi et al., "A Simulation Platform for Metro Automatic Without Driver Signal System", Tiedao Tongxin Xinhao=Railway Signalling & Communication, Sep. 17, 2016 Zhongguo Tiedao Kexue Yanjiuyuan, China Academy of Railway Sciences, vol. 52 No. 9, Sep. 2016, pp. 89-91, with English Abstract.

* cited by examiner

TRAIN OBSTACLE INFORMATION DISPLAY METHOD AND DEVICE

BACKGROUND OF THE INVENTION

1. Technical Field

The invention relates to train signal control systems, in particular to a train obstacle information display method and device.

2. Description of Related Art

In urban rail transit, the complication of systems leads to an arrangement of increasingly more screens on the console to prompt drivers to perform corresponding operations. However, because of the limited space on the console, there may be no suitable area for installing screens for systems added later, leading to inconvenience in use. In addition, with the maturation of the automatic driving technology, ever more lines adopt a driverless train operation (DTO) mode or even an unattended train operation (UTO) mode, in which trains are no longer equipped with a cab, and a corresponding display screen is also eliminated because there is no space for installing the display screen; and even if there is a space for installing the display screen, for the sake of information security, common passengers should not be access to train operation information.

The train obstacle detection system, as a technique emerging in recent years, realizes obstacle perception and handling during train operation by means of video cameras, laser radar, millimeter-wave radar and other sensors. The train obstacle detection system, as a new product, is rarely installed on trains during the production process and is generally added to trains after delivery, so there is no space for installing a display screen for displaying obstacle information. In a GoA3 DTO mode, faults are handled by attendants. In a GoA4 UTO mode, faults are handled automatically. In existing practice, both trains in the DTO mode and trains in the UTO mode are still equipped with train attendants to improve the operation safety. There is no longer a fixed seat, display screen and console for the train attendants, and the train attendants can walk around in compartments like common passengers. The train attendants communicate with a dispatch center by means of intercoms and cannot directly obtain the operating state of trains, and particularly, the train attendants cannot know the operating state of the obstacle detection system added later and can only be informed by the dispatch enter, leading to low efficiency.

BRIEF SUMMARY OF THE INVENTION

The objective of the invention is overcome the above-mentioned defects in the prior art by providing a train obstacle information display method and device.

The objective of the invention can be fulfilled by the following technical solution:

In a first aspect, the invention provides a train obstacle information display method, wherein the method allows a train attendant to obtain an operating state of an on-board obstacle detection system in real time and informs the train attendant immediately when an obstacle disturbing train operation appears, such that the train attendant walks to a head of a train to handle a traffic interruption accident caused by the obstacle;

and when reaching the head of the train, the train attendant handles the accident according to an approach suggested by a handheld mobile terminal.

As a preferred technical solution, the method comprises the following steps:

S101, collecting train operation information, sensor information and obstacle information and sending the collected train operation information, sensor information and obstacle information to the handheld mobile terminal, by an on-board host computer of a train autonomous perception system;

S102, receiving and displaying, by the handheld mobile terminal, the train operation information, sensor information and obstacle information sent from the on-board host computer;

S103, communicating with a server installed at a ground dispatch center to report the self-condition and acquire an instruction from the ground dispatch center, by the handheld mobile terminal;

S104, when the on-board host computer detects the obstacle, giving an audible and visual alarm and vibrating continuously by the handheld mobile terminal to remind the train attendant to handle the accident as soon as possible, and displaying, by the handheld mobile terminal, an obstacle handling suggestion and approach to the train attendant for reference; and

S105, after the accident is handled, reporting, by the train attendant, an obstacle handling result to the ground dispatch center by means of the handheld mobile terminal.

As a preferred technical solution, the handheld mobile terminal is bound to the on-board host computer to establish corresponding communication with the on-board host computer.

As a preferred technical solution, the handheld mobile terminal is bound to the on-board host computer by scanning an on-board QR code or using NFC.

As a preferred technical solution, the handheld mobile terminal has an authority verification function; when the handheld mobile terminal is bound to log in, authority verification is performed by the server or the on-board host computer; and the handheld mobile terminal is allowed to communicate with the on-board host computer and the server after passing the authority verification.

As a preferred technical solution, after being bound and passing through the authority verification, the handheld mobile terminal displays the train operation information, including train number, speed, position and next station.

As a preferred technical solution, the handheld mobile terminal displays the sensor information sent from the on-board host computer, wherein the sensor information includes original point cloud presentations or original images or videos.

As a preferred technical solution, the handheld mobile terminal displays obstacle simulation information processed by the on-board host computer, wherein the obstacle simulation information includes a number, direction, size and distance of obstacles.

As a preferred technical solution, the handheld mobile terminal has a communication connection state monitoring function for monitoring a communication state between the handheld mobile terminal and the on-board host computer, and when the handheld mobile terminal is disconnected from the on-board host computer, the handheld mobile terminal reminds users to check and reconnect the handheld mobile terminal and the on-board host computer.

In a second aspect, the invention provides an apparatus for the train obstacle information display method, comprising a handheld mobile terminal with a communication function and an APP installed in the handheld mobile terminal, wherein train obstacle information is checked by means of the handheld mobile terminal.

In a third aspect, the invention provides an electronic device, comprising a memory and a processor, wherein a computer program is stored in the memory, and when executing the computer program, the processor implements the method mentioned above.

In a fourth aspect, the invention provides a computer-readable storage medium having a computer program stored therein, wherein the method mentioned above is implemented when the computer program is executed.

Compared with the prior art, the invention has the following advantages:

(1) The method provided by the invention allows a train attendant to obtain the operating state of an on-board obstacle detection system in real time and informs the train attendant immediately when an obstacle disturbing train operation appears, such that the train attendant can walk to the head of a train to handle a traffic interruption accident caused by the obstacle, and when reaching the head of the train, the train attendant can handle the accident according to an approach suggested by a terminal.

(2) The method provided by the invention can display obstacle information to train attendants on metro lines in a DTO mode and a UTO mode.

(3) Compared with the method of installing a screen on a train, the method provided by the invention is flexible, and train attendants do not stay at the head of trains to check the train operation state and can walk back and forth in the compartments to inspect the compartments.

(4) The apparatus provided by the invention can emit an alarm automatically when detecting an obstacle, thus reducing the monitoring work pressure of train attendants.

(5) The apparatus provided by the invention can check the train operation state and the state of the obstacle detection system at any time and can check video information in front of trains, such that train attendants do not need to stay at the head of the trains anymore.

DETAILED DESCRIPTION OF THE INVENTION

The technical solutions of the embodiments of the invention will be clearly and completely described below in conjunction with the accompanying drawings of the embodiments of the invention. Obviously, the embodiments in the following description are merely illustrative ones, and are not all possible ones of the invention. All other embodiments obtained by those ordinarily skilled in the art according to the following ones without creative labor should also fall within the protection scope of the invention.

The invention provides a train obstacle information display method. The train obstacle information display method allows a train attendant to obtain an operating state of an on-board obstacle detection system in real time and informs the train attendant immediately when an obstacle disturbing train operation appears, such that the train attendant can walk to the head of a train to handle a traffic interruption accident caused by the obstacle; and when reaching the head of the train, the train attendant can handle the accident according to an approach suggested by a terminal.

Figure 1:
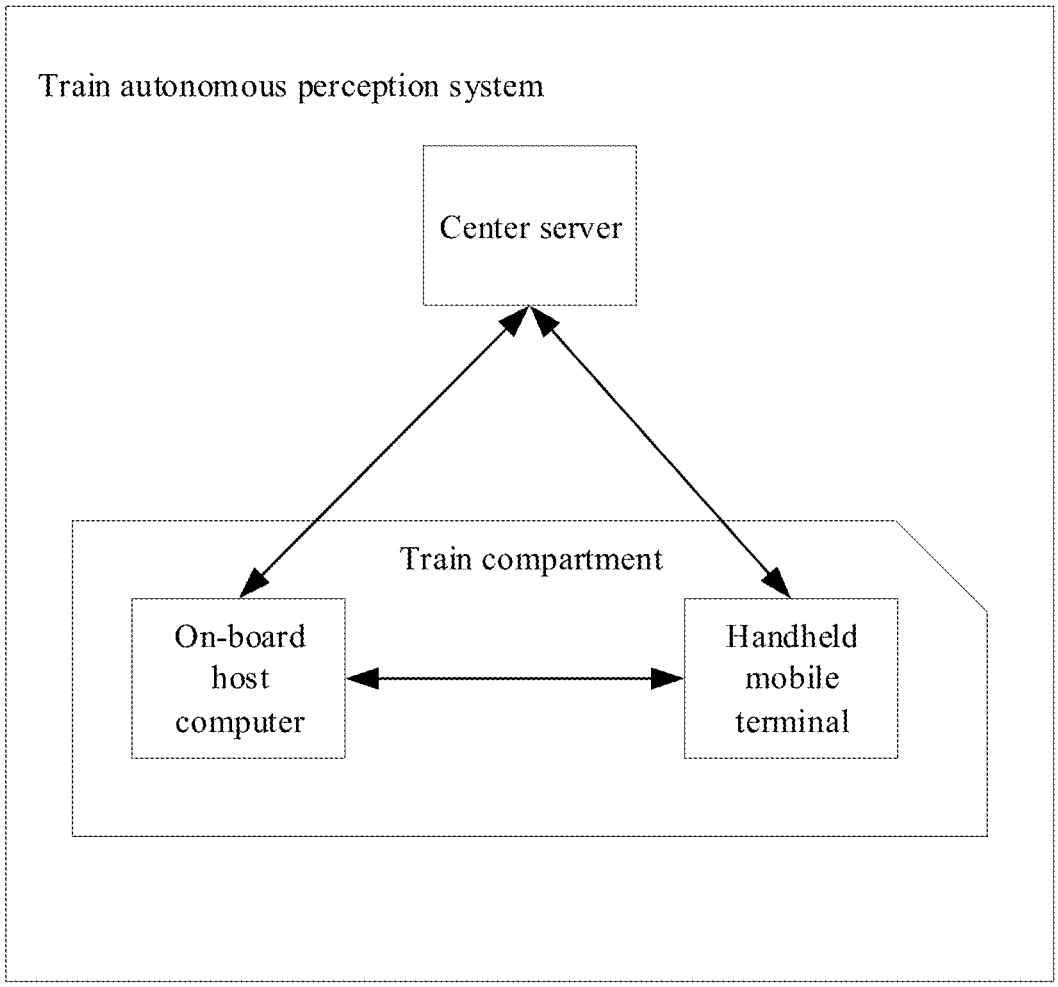
FIG. 1 is a schematic diagram of the position and connection relation of a handheld mobile terminal in a train autonomous perception system according to the invention.
Figure 2:
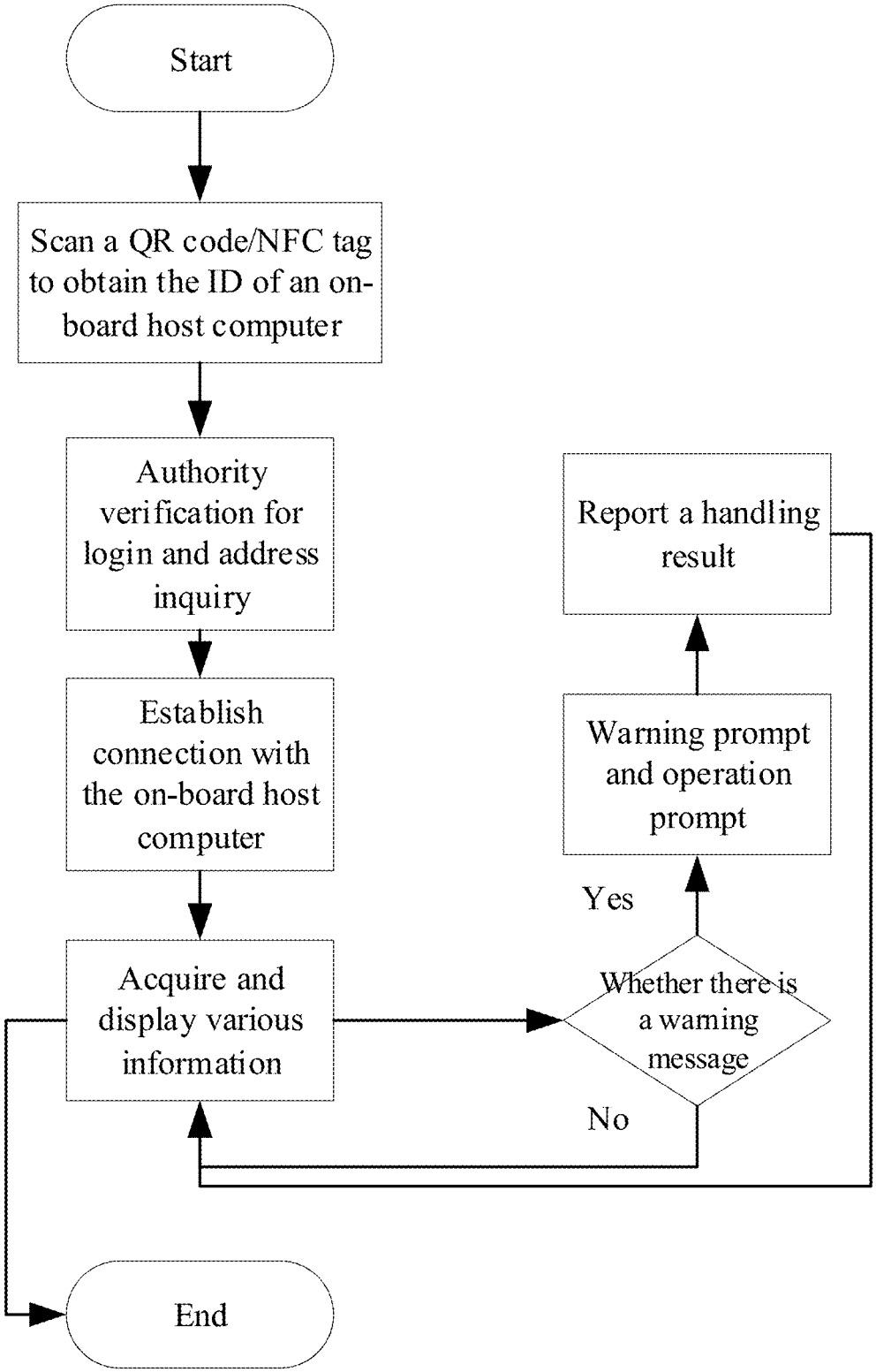
FIG. 2 is a workflow diagram of the handheld mobile terminal according to the invention.

A train autonomous perception system comprises multiple subsystems, wherein an on-board subsystem and a server subsystem of the train autonomous perception system are related to a handheld mobile terminal, as shown in FIG. 1. The on-board subsystem is installed at each of the two ends of a train and comprises a sensor and a processing host computer, and a center server is generally installed at a dispatch center. The handheld mobile terminal is carried by the train attendant, and when on duty, the train attendant brings the handheld mobile terminal on the train and uses the handheld mobile terminal on the train. The handheld mobile terminal, the on-board host computer and the center server are in communication connection with each other, and the handheld mobile terminal can also directly communicate with the on-board host computer.

The handheld mobile terminal is used generally as follows:

After being started, the handheld mobile terminal reads a profile to obtain a server address and scans/reads the ID of the on-board host computer by scanning a QR code or reading an NFC tag. The tag includes the ID of the train and is pasted at a specific position of the train compartment to distinguish different trains.

After obtaining the server address and the ID of the train, the handheld mobile terminal sends the server address, the ID of the train and the ID of its own to the center server for login authority verification. If passing the authority verification, the handheld mobile terminal will be allowed to be connected to the network, and the address of the on-board host computer will be issued at the same time, such that the handheld mobile terminal and the on-board host computer are bound together. If failing to pass the authority verification, the handheld mobile terminal will not be allowed to be connected to the on-board host computer and will not obtain related information. In this way, unauthorized users will not be able to obtain information, and information will not leak even if the handheld mobile terminal is lost, thus guaranteeing information security.

The handheld mobile terminal establishes communication with the on-board host computer according to the address of the on-board host computer; and after the handheld mobile terminal establishes communication with the on-board host computer, the on-board host computer periodically sends train operation information, such as the train number and speed of the current train, the position of the current train and the next station, to the handheld mobile terminal. In addition, the on-board host computer also sends obstacle detection information, including the number, direction, size and distance of obstacles, to the handheld mobile terminal.

The train attendant can selectively check original outputs, such as laser point clouds and video outputs, of the sensor at the front end/rear end of the train and can perform switching, rotation or other operations by means of an interface.

When detecting an obstacle, the on-board host computer instantly sends warning information to the handheld mobile terminal to drive the handheld mobile terminal to give an audible and visual alarm and vibrate continuously to remind the train attendant to handle the obstacle. At the same time, the on-board host computer performs corresponding processing. Specifically, if the on-board host computer is connected to a signal system, the on-board host computer will participate in train control by means of on-board devices of the signal system; if the on-board host computer is directly connected to a train braking unit, the on-board host computer will output a train braking instruction.

When the on-board host computer detects the obstacle and performs emergency braking to stop the train, the handheld mobile terminal displays obstacle information to the train attendant for reference, and at this moment, the train attendant can re-check the obstacle information by visual observation or checking original data of the on-board sensors. The handheld mobile terminal can also obtain an obstacle handling suggestion and approach from the sever to guide the train attendant to solve problems and then upload an obstacle handling process and result. After the accident is handled, the handheld mobile terminal returns to a normal display mode and continues to acquire and display various information.

In use, the handheld mobile terminal will continuously monitor the communication connection between the handheld mobile terminal and the on-board host computer, and once the handheld mobile terminal is disconnected from the on-board host computer, users will be reminded that the terminal is not available at present and will be prompted to check and reconnect the handheld mobile terminal and the on-board host computer, for example, by carrying the handheld mobile terminal to a place closer to the on-board host computer or a place where signals are barely shielded.

The realization of the above function of the handheld mobile terminal relies on the hardware capacity, such as a power supply, a QR code scanning module, an NFC module and a network communication module, and software, such as the APP specially developed for the above function, of the handheld mobile terminal, and the hardware capacity and the software of the handheld mobile terminal can be changed and upgraded as required by users so as to improve user satisfaction.

The communication method between the subsystems is not limited in the invention and depends on the specific implementation of a project. The communication method may be WLAN communication, mobile data communication and other NFC methods. All these changes should be considered as falling within the permitted scope of the patent of the invention and should not be regarded as new patents.

The embodiment of the method is introduced above, and the technical solution of the invention will be further explained below with reference to an embodiment of an apparatus.

As shown in FIG. 1, the invention further provides an apparatus for implementing the method. Specifically, the apparatus comprises a handheld mobile terminal, and after an APP is installed in the handheld mobile terminal, train obstacle information can be checked by means of the handheld mobile terminal. A train autonomous perception system, as a whole, can endow multiple trains on metro lines with an obstacle perception ability, and the apparatus is one part of the train autonomous perception system and plays a role of displaying obstacle information as a subsystem.

Those skilled in the art can clearly know that, to facilitate and simplifying the description, the specific operating process of the modules described above can be understood with reference to corresponding processes in the embodiment of the method mentioned above and will not be repeated here.

An electronic device provided by the invention comprises a central processing unit (CPU), which can perform various appropriate actions and processing according to computer program instructions stored in a read only memory (ROM) or computer program instructions loaded into a random access memory (RAM) from a storage unit. Various programs and data required for operations of the device can also be stored in the RAM. The CPU, ROM and RAM are connected by means of a bus. An input/output (I/O) interface is also connected to the bus.

Multiple components in the device are connected to the I/O interface, including an input unit such as a keyboard or a mouse; an output unit such as various displays or speakers; a storage unit such as a magnetic disk or a compact disc; and a communication unit such as a network card, a modem or a wireless communication transceiver. The communication unit allows the device to exchange information/data with other devices by means of, for example, computer networks based on the internet and/or various telecommunication networks.

The processing unit performs the steps and processing described above, such as the method S101-S105. For example, in some embodiments, the method S101-S105 can be implemented as a computer software program, which is tangibly stored in a machine-readable medium such as the storage unit. In some other embodiments, the computer program may be partially or entirely loaded and/or installed on the device by means of the ROM and/or the communication unit. When the computer program is loaded into the RAM and executed by the CPU, one or more of the steps of the method S101-S105 described above can be performed. Alternatively, in other embodiments, the CPU can be configured to implement the method S101-S105 in any other appropriate ways (such as, by means of firmware).

At least part of the functions described above can be performed by one or more hardware logic components. For example, non-restrictively, illustrative hardware logic components that can be used include: a field programmable gate array (FPGA), an application-specific integrated circuit (ASIC), an application-specific standard product (ASSP), a system on chip (SOC), a complex programmable logic device (CPLD), and the like.

Program codes for implementing the method of the invention may be written in one programming language or any combination of multiple programming languages. These program codes can be provided to a processor or a controller of a general-purpose computer, a special-purpose computer or other programmable data processing devices, such that when the program codes are executed by the processor or controller, the functions/operations specified in the flow diagram and/or block diagram are performed. The program codes may be entirely executed on a machine, partially executed on a machine, partially executed on a machine as an independent software package and partially executed on a remote machine, or entirely executed on a remote machine or server.

In the context of the invention, the machine-readable medium may be a tangible medium, and may comprise or store a program, which is used by or in conjunction with an instruction execution system, apparatus or device. The machine-readable medium may be a machine-readable signal medium or a machine-readable storage medium. The machine-readable medium may comprise, but is not limited to, electronic, magnetic, optical, electromagnetic, infrared or semiconductor systems, apparatuses or devices, or any suitable combinations thereof. More specific examples of the machine-readable storage medium comprise an electrical connection based on one or more wires, a portable computer disk, a hard disk, a random access memory (RAM), a read only memory (ROM), an erasable programmable read only memory (EPROM or flash memory), an optical fiber, a portable compact disc read only memory (CD-ROM), an optical storage device, a magnetic storage device, or any combinations thereof.

The above embodiments are merely specific ones of the invention, and the protection scope of the invention is not limited to the above embodiments. Any skilled in the art can easily think out various equivalent modifications or substitutions within the technical scope disclosed by the invention, and all these equivalent modifications or substitutions should fall within the protection scope of the invention. Therefore, the protection scope of the invention should be subject to the protection scope of the claims.

What is claimed is:

1. A train obstacle information display method, wherein the method allows a train attendant to obtain an operating state of an on-board obstacle detection system in real time and informs the train attendant immediately when an obstacle disturbing train operation appears, such that the train attendant walks to a head of a train to handle a traffic interruption accident caused by the obstacle;

and when reaching the head of the train, the train attendant handles the accident according to an approach suggested by a handheld mobile terminal, wherein the method comprises the following steps:

S101, collecting train operation information, sensor information and obstacle information and sending the collected train operation information, sensor information and obstacle information to the handheld mobile terminal, by an on-board host computer of a train autonomous perception system;

S102, receiving and displaying, by the handheld mobile terminal, the train operation information, sensor information and obstacle information sent from the on-board host computer;

S103, communicating with a server installed at a ground dispatch center to report self-condition and acquire an instruction from the ground dispatch center, by the handheld mobile terminal;

S104, when the on-board host computer detects the obstacle, giving an audible and visual alarm and vibrating continuously by the handheld mobile terminal to remind the train attendant to handle the accident as soon as possible, and displaying, by the handheld mobile terminal, an obstacle handling suggestion and approach to the train attendant for reference; and

S105, after the accident is handled, reporting, by the train attendant, an obstacle handling result to the ground dispatch center by means of the handheld mobile terminal.

2. The train obstacle information display method according to claim 1, wherein the handheld mobile terminal is bound to the on-board host computer to establish corresponding communication with the on-board host computer.

3. The train obstacle information display method according to claim 2, wherein the handheld mobile terminal is bound to the on-board host computer by scanning an on-board QR code or using NFC.

4. The train obstacle information display method according to claim 1, wherein the handheld mobile terminal has an authority verification function; when the handheld mobile terminal is bound to log in, authority verification is performed by the server or the on-board host computer; and the handheld mobile terminal is allowed to communicate with the on-board host computer and the server after passing the authority verification.

5. The train obstacle information display method according to claim 4, wherein after being bound and passing through the authority verification, the handheld mobile terminal displays the train operation information, including train number, speed, position and next station.

6. The train obstacle information display method according to claim 1, wherein the handheld mobile terminal displays the sensor information sent from the on-board host computer, wherein the sensor information includes original point cloud presentations or original images or videos.

7. The train obstacle information display method according to claim 1, wherein the handheld mobile terminal displays obstacle simulation information processed by the on-board host computer, wherein the obstacle simulation information includes a number, direction, size and distance of obstacles.

8. The train obstacle information display method according to claim 1, wherein the handheld mobile terminal has a communication connection state monitoring function for monitoring a communication state between the handheld mobile terminal and the on-board host computer, and when the handheld mobile terminal is disconnected from the on-board host computer, the handheld mobile terminal reminds users to check and reconnect the handheld mobile terminal and the on-board host computer.

9. An apparatus for the train obstacle information display method according to claim 1, comprising a handheld mobile terminal with a communication function and an APP installed in the handheld mobile terminal, wherein train obstacle information is checked by means of the handheld mobile terminal.

10. An electronic device, comprising a memory and a processor, a computer program being stored in the memory, wherein the method according to claim 1 is implemented when the processor executes the computer program.

11. A computer-readable storage medium, having a computer program stored therein, wherein the method according to claim 1 is implemented when the computer program is executed by a processor.

* * * * *